US007341027B2

(12) United States Patent
Sugiyama

(10) Patent No.: US 7,341,027 B2
(45) Date of Patent: Mar. 11, 2008

(54) PORTABLE 4-CYCLE ENGINE AND PORTABLE MACHINE EQUIPPED WITH THE 4-CYCLE ENGINE

(75) Inventor: Masaki Sugiyama, Shizuoka-ken (JP)

(73) Assignee: Makita Numazu Corporation, Numazu-Shi, Shizuoka-Ken (JP)

( * ) Notice: Subject to any disclaimer, the term of this patent is extended or adjusted under 35 U.S.C. 154(b) by 0 days.

(21) Appl. No.: 11/510,808

(22) Filed: Aug. 28, 2006

(65) Prior Publication Data

US 2007/0169726 A1 Jul. 26, 2007

(30) Foreign Application Priority Data

Jan. 20, 2006 (JP) ..... 2006-012876
Jan. 20, 2006 (JP) ..... 2006-012877

(51) Int. Cl.
*F01P 7/04* (2006.01)

(52) U.S. Cl. ..... 123/41.65; 123/41.69

(58) Field of Classification Search ..... 123/41.65, 123/41.69

See application file for complete search history.

(56) References Cited

U.S. PATENT DOCUMENTS 2,725,045 A * 11/1955 Flatz et al. ..... 123/41.69
2,753,853 A * 7/1956 Hands ..... 123/41.67
2,985,155 A * 5/1961 Hockel ..... 123/41.69
4,216,746 A * 8/1980 Freyn ..... 123/41.69
5,564,374 A * 10/1996 Hoffman et al. ..... 123/90.23
5,588,408 A * 12/1996 Kurihara ..... 123/196 W
5,606,944 A * 3/1997 Kurihara ..... 123/90.31
6,039,020 A * 3/2000 Kawamoto et al. ..... 123/196 R

FOREIGN PATENT DOCUMENTS

JP 60-5774 2/1985
JP 3159296 2/2001

* cited by examiner

*Primary Examiner*—Noah P. Kamen
(74) *Attorney, Agent, or Firm*—McGinn IP Law Group, PLLC

(57) ABSTRACT

A portable 4-cycle engine with a configuration which allows cooling air to flow in the direction of the crankshaft relative to a cylinder head on a cylinder, and a portable machine equipped with this engine, are provided, respectively. In such an engine, the cylinder is separated from the cylinder head including a combustion chamber formed at the cylinder side therein. The engine further comprises a valve train area formed in the cylinder head at the downwind side of the cooling air, and a plurality of vertical fins protruding upward from the cylinder head and extending in the direction of the crankshaft. The valve train area and the plurality of vertical fins are all integrally formed with the cylinder head, so that the cylinder head can be made thinner and lighter with high rigidity to enable the portable machine to become smaller, lighter, and more powerful.

13 Claims, 9 Drawing Sheets

PRIOR ART

PORTABLE 4-CYCLE ENGINE AND PORTABLE MACHINE EQUIPPED WITH THE 4-CYCLE ENGINE

BACKGROUND OF THE INVENTION

The present invention relates to a portable 4-cycle engine used for driving a portable machine such as a back pack blower or a bush cutter, and to the portable machine equipped with the 4-cycle engine.

The present application claims priority from Japanese Patent Application Nos. 2006-012876 and 2006-012877, the disclosures of which are incorporated herein by reference.

Combustion chamber shapes for ideal 4-cycle engine performance have been studied in order to improve the output of the engine, or to reduce harmful exhaust-gas emissions. For example, the wedge-shaped combustion chamber and the bathtub combustion chamber are known (see Japanese Examined Patent Publication No. Sho 60-5774). Some large 4-cycle engines for use in vehicles or the like have a separate cylinder and cylinder head to achieve a more appropriate combustion chamber shape.

On the other hand, portable 4-cycle engines for use in back pack blowers, bush cutters and the like conventionally have a cylinder head integral with the cylinder because their top-priority requirements are small size and light weight (see, for example, Japanese Patent No. 3159296).

One problem with the engine having a separate cylinder and cylinder head, however, is that the cylinder head must be firmly and air tightly fastened to the cylinder, because otherwise the combustion gas will leak through the interface, resulting in a power loss. Sometimes combustion gas may leak through the interface resulting from thermal expansion of the cylinder head due to a sharp temperature gradient which occurs in the cylinder head where the combustion chamber is formed. Such gas leak causes an engine power loss, and contamination or damage of the engine. Accordingly, improvements in the cooling performance and rigidity of the cylinder head are the crucial issues in designing engines with a separate cylinder and cylinder head.

One of the portable machines, for example, back pack blowers may be operated at length at a high speed of 8,000 rpm, and also bush cutters may be operated in an rpm range of 7,000 to 10,000 rpm. The cylinder and the cylinder head are subjected to high-frequency impact during the operation, and also the cylinder head is subjected to direct impact from the valve train components in the valve train area inside the cylinder head. Therefore, the cylinder head in particular needs to have high rigidity in order to prevent deformation or damage of the cylinder head and to maintain the seal between the cylinder and the cylinder head. Increasing the thickness of the cylinder head or the height of the bosses provided for bolt-tightening with the cylinder leads to an increase in the size and weight of the engine, which is incompatible with the top-priority requirements that the portable machine should be small and light.

For these reasons, portable machines are usually not equipped with 4-cycle engines with a separate cylinder and cylinder head. On the other hand, conventional 4-cycle engines with a one-piece cylinder and cylinder head assembly have reached their limitations in enhancing the engine power output, and portable machines equipped with such engines have a problem of poor operability due to the low engine power output.

The present invention was devised in view of the above problems in the conventional techniques and its object is to provide a portable 4-cycle engine with a small, lightweight, high-power, and high-durability cylinder head for use in portable machines such as back pack blowers, bush cutters and the like which are required to be small, light, and powerful.

Another object of the invention is to provide a portable machine equipped with a 4-cycle engine with improved engine cooling performance, operation efficiency, and maintenance accessibility.

SUMMARY OF THE INVENTION

The portable 4-cycle engine of the present invention is of the type which allows cooling air to flow to the cylinder head on top of the cylinder in the direction of the crankshaft, the cylinder head being separable from the cylinder. To achieve the above object, in one embodiment of the present invention, the 4-cycle engine comprises a cylinder, a cylinder head separately disposed on top of the cylinder and including a combustion chamber at a side of the cylinder, a cooling fan for introducing the cooling air to the cylinder head in which the cooling fan is connected to an end of the crankshaft, a valve train area formed on the cylinder head at the downwind side of the cooling air in the cylinder head, and a plurality of vertical fins protruding upward from the cylinder head and extending in the direction of the crankshaft. In addition, the valve train area and the vertical fins are integrally formed with the cylinder head.

With the configuration in which the valve train area is formed in the cylinder head at the downwind side of the cooling air, and in which the vertical fins protruding upward from the cylinder head and extending in the direction of the crankshaft are integrally formed with the cylinder head, the 4-cycle engine can maintain high rigidity and good cooling performance even though heat and combustion pressure become higher with the increase of the power output of the engine. Thus the 4-cycle engine is small, light, and powerful, and can work to its full potential as the power source of a portable machine.

The configuration with a separate cylinder and cylinder head allows ease in forming an ideal wedge-shaped combustion chamber to enhance the compression ratio and to improve the engine output.

Another embodiment of the portable 4-cycle engine of the present invention, which is of the type which allows cooling air to flow to the cylinder head on top of the cylinder in the direction of the crankshaft, comprises a cylinder, a cylinder head disposed on top of the cylinder including a combustion chamber at a side of the cylinder, and an intake port and an exhaust port, in which both the ports are oppositely formed with each other in the cylinder head in a direction orthogonal to the crankshaft. The engine further comprises a cooling fan connected to an end of the crankshaft for introducing the cooling air to the cylinder head, a valve train area formed above the intake port and the exhaust port, and a plurality of vertical fins protruding upward from the cylinder head and extending in the direction of the crankshaft. In addition, the intake port, the exhaust port, the valve train area and a plurality of the vertical fins are all integrally formed with the cylinder head.

With the configuration in which all of the intake port, the exhaust port, the combustion chamber, the valve train area, and the vertical fins are all integrally formed with the cylinder head, the cylinder head has high rigidity and can be made thinner and lighter. The vertical fins conduct heat from the combustion chamber and the exhaust port to the low-temperature valve train area, and also the vertical fins themselves are cooled by cooling air. Thus, the portable 4-cycle engine is small, light, and powerful, being equipped with the cylinder head with high cooling performance.

One embodiment of the portable machine of the invention is equipped with a 4-cycle engine which is of the type which allows cooling air to flow to the cylinder head on top of the cylinder in the direction of the crankshaft. The 4-cycle engine comprises a cylinder, a cylinder head separately disposed on the cylinder and including a combustion chamber at a side of the cylinder. The engine further comprises a valve train area formed at the downwind side of the cooling air in the cylinder head, and a plurality of vertical fins protruding upward from the cylinder head and extending in the direction of the crankshaft. Additionally, the valve train area and the vertical fins are integrally formed with the cylinder head.

With the configuration of the 4-cycle engine in which the valve train area is formed in the cylinder head at the downwind side of the cooling air, and in which the vertical fins protruding upward from the cylinder head and extending in the direction of the crankshaft are integrally formed with the cylinder head, the 4-cycle engine can maintain high rigidity and good cooling performance even though heat and combustion pressure become higher with the increase of the power output of the engine. Thus the 4-cycle engine can work to its full potential as the power source of the portable machine, and the portable machine is small, light, powerful, and highly operable.

Another embodiment of the portable machine of the invention is equipped with a 4-cycle engine which is of the type which allows cooling air to flow to the cylinder head on top of the cylinder in the direction of the crankshaft, and which includes an intake port and an exhaust port facing each other along a direction orthogonal to the crankshaft, a combustion chamber, provided in the cylinder head, communicating with the intake port and the exhaust port, a valve train area formed above the intake port and the exhaust port, and a plurality of vertical fins protruding upward from the cylinder head and extending in the direction of the crankshaft. The intake port, the exhaust port, the valve train area, and the vertical fins are all integrally formed with the cylinder head.

With the configuration of the 4-cycle engine in which the intake port and the exhaust port facing each other along a direction orthogonal to the crankshaft, the combustion chamber communicating with the intake port and the exhaust port, the valve train area formed above the intake port and the exhaust port, and the vertical fins protruding upward from the cylinder head and extending in the direction of the crankshaft are all integrally formed with the cylinder head, the cylinder head has high rigidity and can be made thinner and lighter. The vertical fins conduct heat from the combustion chamber and the exhaust port to the low-temperature valve train area, and also the vertical fins themselves are cooled by cooling air. Thus, with the 4-cycle engine with high cooling performance, the portable machine is small, light, powerful, and highly operable.

BRIEF DESCRIPTION OF THE DRAWINGS

These and other objects and advantages of the present invention will become clear from the following description with reference to the accompanying drawings, wherein.

DETAILED DESCRIPTION OF PREFERRED EMBODIMENTS

Preferred embodiments of the portable 4-cycle engine and the portable machine equipped with the engine of the present invention will be hereinafter described with reference to the drawings.

Figure 2:
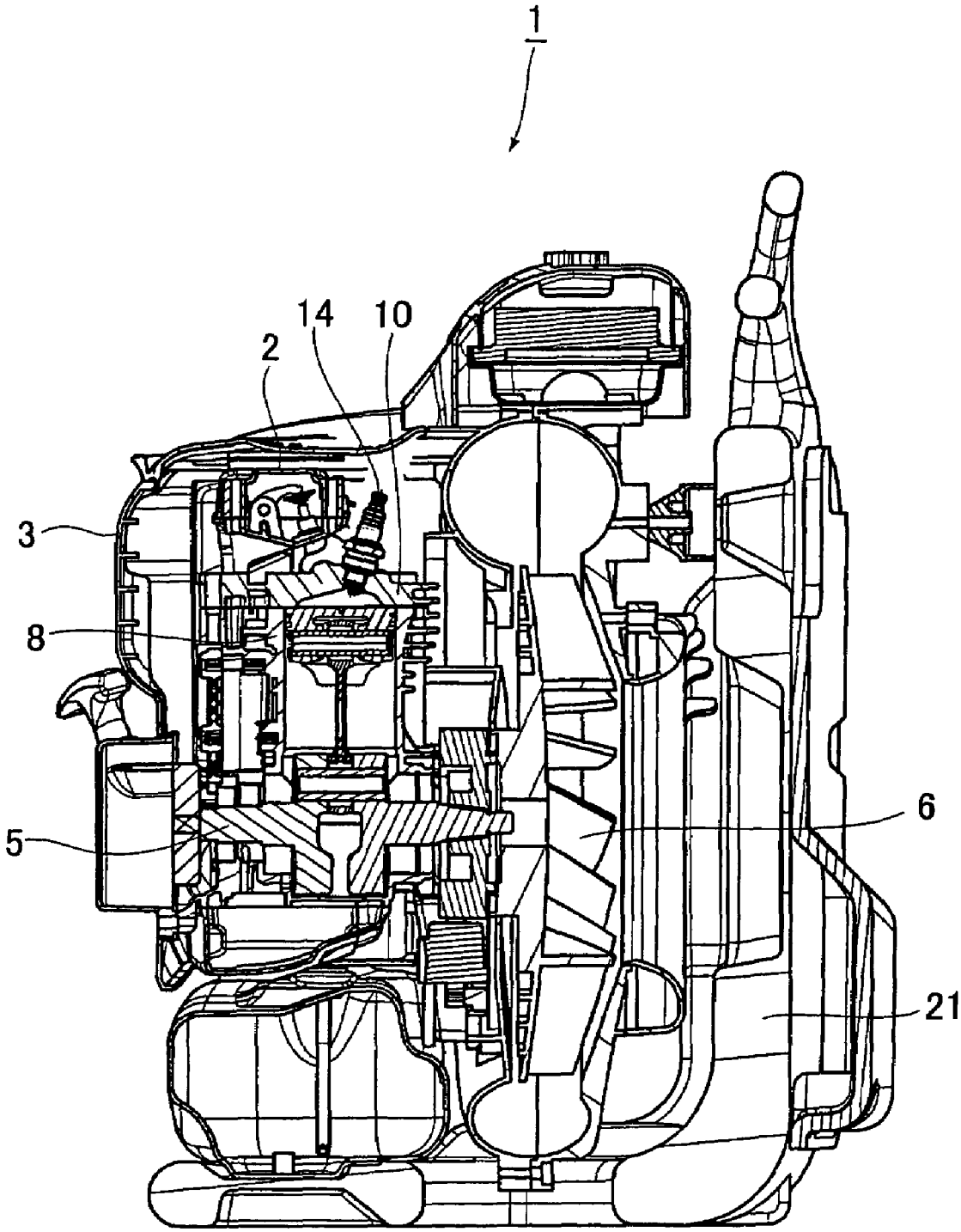
FIG. 2 is a cross-sectional view of a portable machine equipped with the 4-cycle engine according to one embodiment of the present invention.

Referring to FIG. 2, the 4-cycle engine 2 includes a cylinder 8, a cylinder head 10, and a crankshaft 5. To one end of the crankshaft 5 is coaxially secured a fan 6 for blowing air. An ignition plug 14 is arranged at the fan side of the cylinder head 10. The engine 2 is encased in an engine cover 3, which forms a passage through which part of the air current created by the fan 6 flows for cooling the engine 2. The blower body including the 4-cycle engine encased in the engine cover 3 and the fan 6 is attached to a back pack frame 21.

Figure 3:
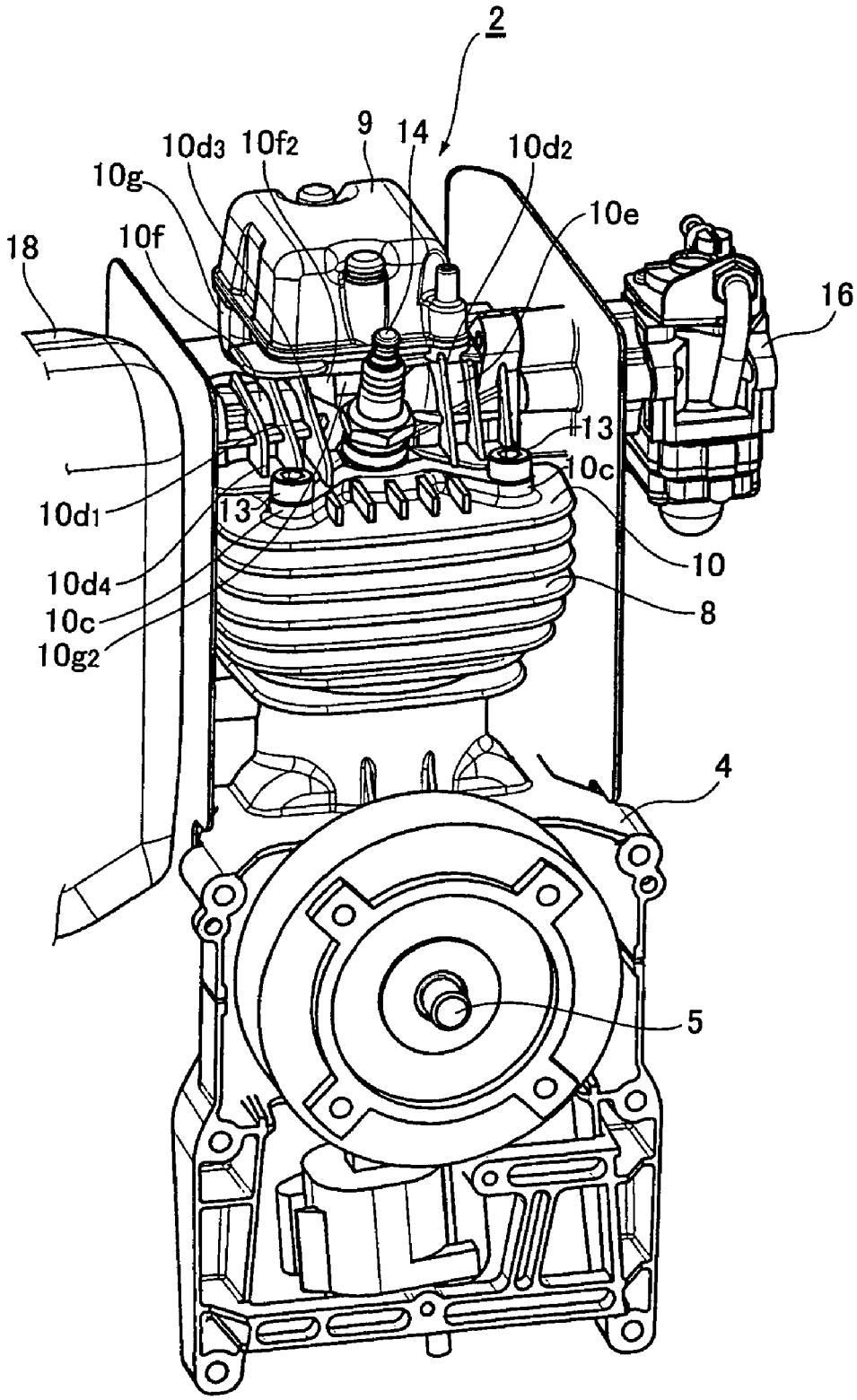
FIG. 3 is a perspective view of the outer appearance of the portable 4-cycle engine according to one embodiment of the present invention.
Figure 4:
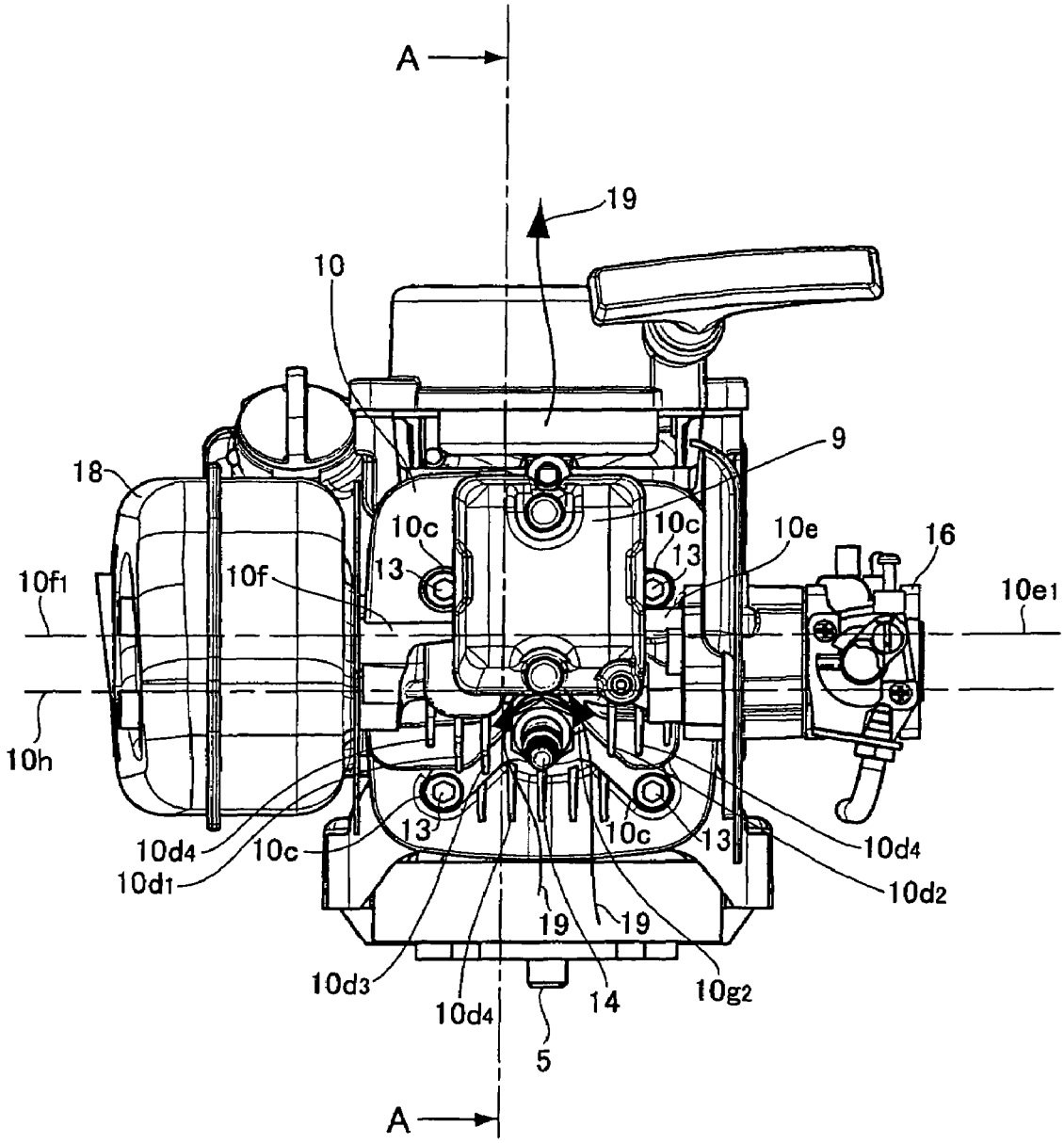
FIG. 4 is a top view of the portable 4-cycle engine according to one embodiment of the present invention.

FIG. 3 is a perspective view of the outer appearance of the portable 4-cycle engine 2 equipped on the portable machine 1 according to the present embodiment, and FIG. 4 is a top view of FIG. 3. Referring to these drawings, a carburetor 16 and a muffler 18 are attached to the sides of the engine 2. The cylinder 8, which is for example an aluminum alloy die-casted, is located on top of the crank case 4 which rotatably supports the crankshaft 5. The cylinder head 10, which is similarly an aluminum alloy die-casted, is mounted on top of on the cylinder 8. The cylinder head 10 is securely fastened to the cylinder 8 by tightening bolts 13 using bolt head shoulders 10*c* provided at four locations of the cylinder head 10.

Fuel such as gasoline supplied from a fuel tank (not shown) is mixed with air in the carburetor 16 and fed to the combustion chamber 15 (see FIG. 6) to be described later through an intake port 10*e*. The intake valve 20 (see FIG. 6) opens and the fuel/air mixture is fed into the combustion chamber 15, where the 4-stroke cycles, intake stroke, compression stroke, combustion stroke, and exhaust stroke, are repeated. The exhaust valve 12 (see FIG. 6) opens in the exhaust stroke to let out exhaust gas from the combustion chamber 15 through an exhaust port 10*f* to the muffler 18, through which the gas is discharged to the outside.

The intake port 10*e* and the exhaust port 10*f* are opposite each other and integrally formed at the top of the cylinder head 10. One end of the intake port 10*e* communicates with the combustion chamber 15 (see FIG. 6) to be described later, which is formed under the lower face and substantially in the middle of the cylinder head 10. The other end of the intake port is connected to the carburetor 16 through a heat insulator. The exhaust port 10*f* also communicates with the combustion chamber 15 at one end, the other end being connected to the muffler 18.

Above the intake port 10*e* and the exhaust port 10*f* is a valve train area 10*g* accommodating the valve train components including an intake valve 20, an exhaust valve 12, push rods 11, and others which will be described later. The valve train area 10*g* is integrally formed with the intake port 10*e* and the exhaust port 10*f* being connected to them by using a pair of valve guide bosses 10*f*2. The valve train area 10*g* is located in the cylinder head 10 at the downwind side. The upper part of the valve train area 10*g* is closed by a rocker cover 9.

Figure 7:
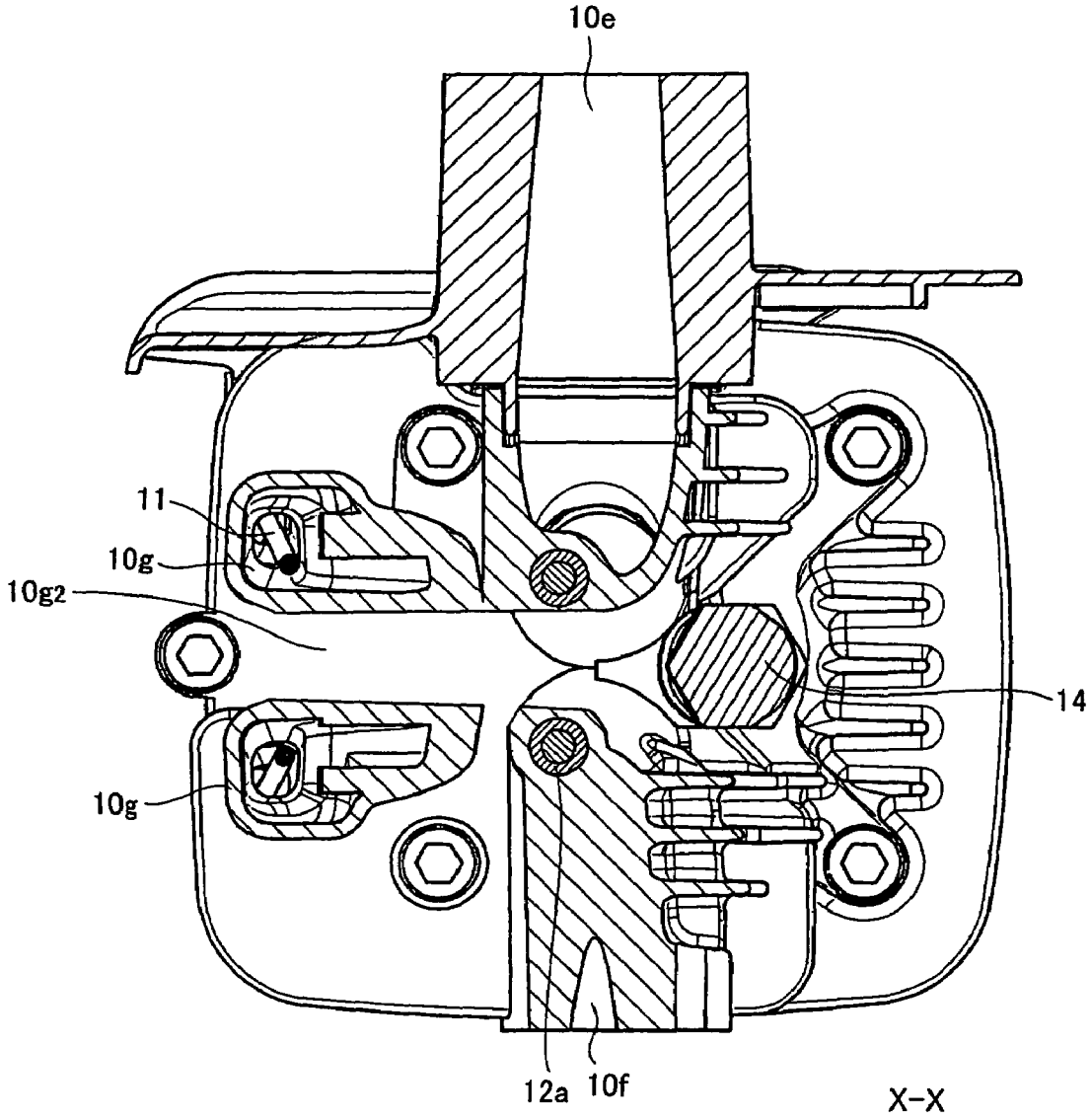
FIG. 7 is a cross-sectional view taken along the line X-X of FIG. 5.

As shown in FIGS. 3 and 7, an opening 10*g*2, formed by the intake port 10*e*, exhaust port 10*f*, valve guide bosses 10*f*2, and valve train area 10*g*, form the passage for the cooling air from the fan 6 attached to the crankshaft 5. The cooling air flows as indicated by the arrows 19 in FIG. 4. The opening 10*g*2 has a decreasing cross-sectional area from the upwind side toward the downwind side, so that cooling air entering from the wider passage entrance increases its speed as it flows toward the downwind side and cools the cylinder head 10 with enhanced efficiency.

A plurality of vertical fins 10*d*1, 10*d*2, 10*d*3, and 10*d*4 are integrally formed with the upper part of the cylinder head 10 on the side of the fan 6, i.e., on the upwind side of the cooling air. These fins 10*d*1, 10*d*2, 10*d*3, and 10*d*4 not only guide the cooling air efficiently and enhance the cooling effect for the cylinder head 10, but also increase the rigidity of the cylinder head 10 and the intake port 10*e*, exhaust port 10*f*, valve guide bosses 10*f*2, and valve train area 10*g* that are integrally formed with the cylinder head 10.

This configuration of the portable 4-cycle engine 2 with a separable cylinder 8 and cylinder head 10 allows ease in forming an ideal combustion shape in the cylinder head 10 to enhance the compression ratio and to improve the engine output. The increase in the engine output increases the heat and combustion pressure but this can be dealt with by the enhanced rigidity and cooling performance of the engine 2 due to the configuration in which the valve train area 10*g* is located on the cylinder head 10 at the downwind side of the cooling air and in which a plurality of vertical fins 10*d*1 to 10*d*4 protruding upwards from the cylinder head 10 and extending along the direction of the crankshaft 5 are integrally formed with the cylinder head 10. Therefore, the 4-cycle engine 2 is small, light, and powerful, and can work to its full potential as the power source of a portable machine.

In this embodiment, the ignition plug 14 is located near the opening 10*g*2 on the upwind side, and interposed between the vertical fins 10*d*2 and 10*d*3. The vertical fin 10*d*3 is joined to the valve guide boss 10*f*2 and the valve train area 10*g*. The joint between the vertical fin 10*d*3, and the valve guide boss 10*f*2 is connected to the outer end of the valve guide boss 10*f*2 away from its center in a direction orthogonal to the crankshaft direction. The cooling air flowing from the upwind side bifurcates at the ignition plug 14, but because of this configuration, it is not dissipated by the vertical fins 10*d*2 and 10*d*3 and effectively cools the outer circumference of the valve guide boss 10*f*2, and the air currents meet at the opening 10*g*2 and cool the outer circumference of the intake port 10*e* and the exhaust port 10*f*.

The opening 10*g*2 which is wider on the upwind side readily takes in cooling air, and its tapering shape in the downwind side increases speed of the airflow towards the downwind side, improving cooling efficiency for the surrounding of the valve guide bosses 10*f*2. Particularly, temperature around the valve guide 12*b* of the exhaust port 10*f* (see FIG. 5) tends to rise because of the heat of exhaust gas directly coming out of the combustion chamber 15 (see FIG. 5). Therefore, efficient cooling of the surrounding of the hot valve guide 12*b* enables well-balanced cooling of the entire cylinder head 10.

Figure 5:
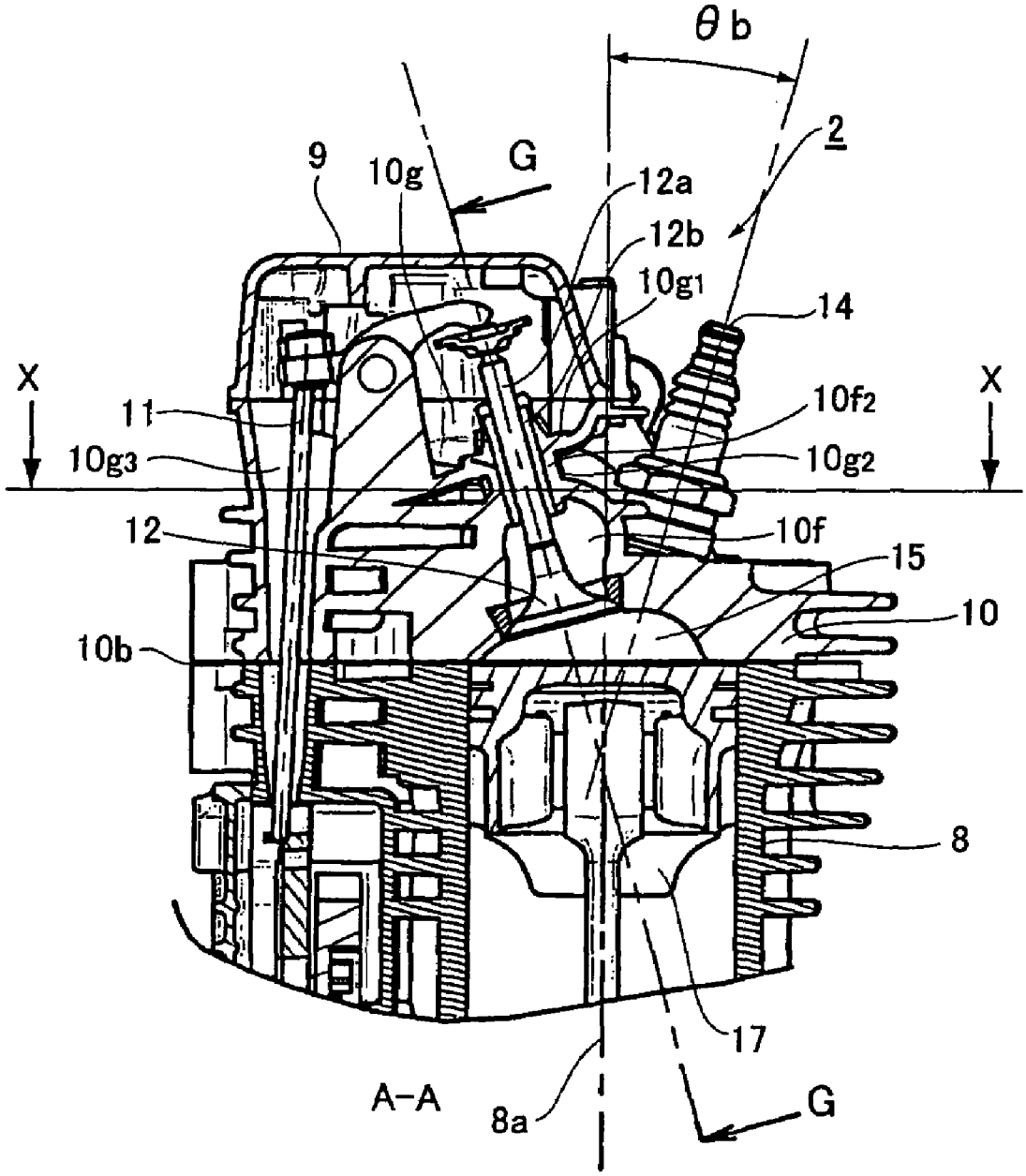
FIG. 5 is a cross-sectional view taken along the line A-A of FIG. 4.

Reference numeral 10*h* denotes a phantom line orthogonal to the crankshaft 5 drawn at the position where it intersects the centerline 8*a* of the cylinder 8 (see FIG. 5). Reference numerals 10*e*1 and 10*f*1 respectively denote phantom lines indicating the centerlines of the intake port 10*e* and the exhaust port 10*f*. In this embodiment, the centerlines of the intake port 10*e* and the exhaust port 10*f* are positioned at the downwind side relative to the centerline 8*a* of the cylinder 8. This allows the cylinder head 10 to have a wider area on the upwind side for providing space for a number of vertical fins 10*d*1 to 10*d*4. In this embodiment, the vertical fins 10*d*1 and 10*d*2 are joined to the valve train area 10*g* at both ends in the direction orthogonal to the crankshaft 5, in order to increase the rigidity of the valve train area 10*g*. Thus the cylinder head 10 is small and light, and yet has excellent cooling performance and high rigidity.

Figure 6:
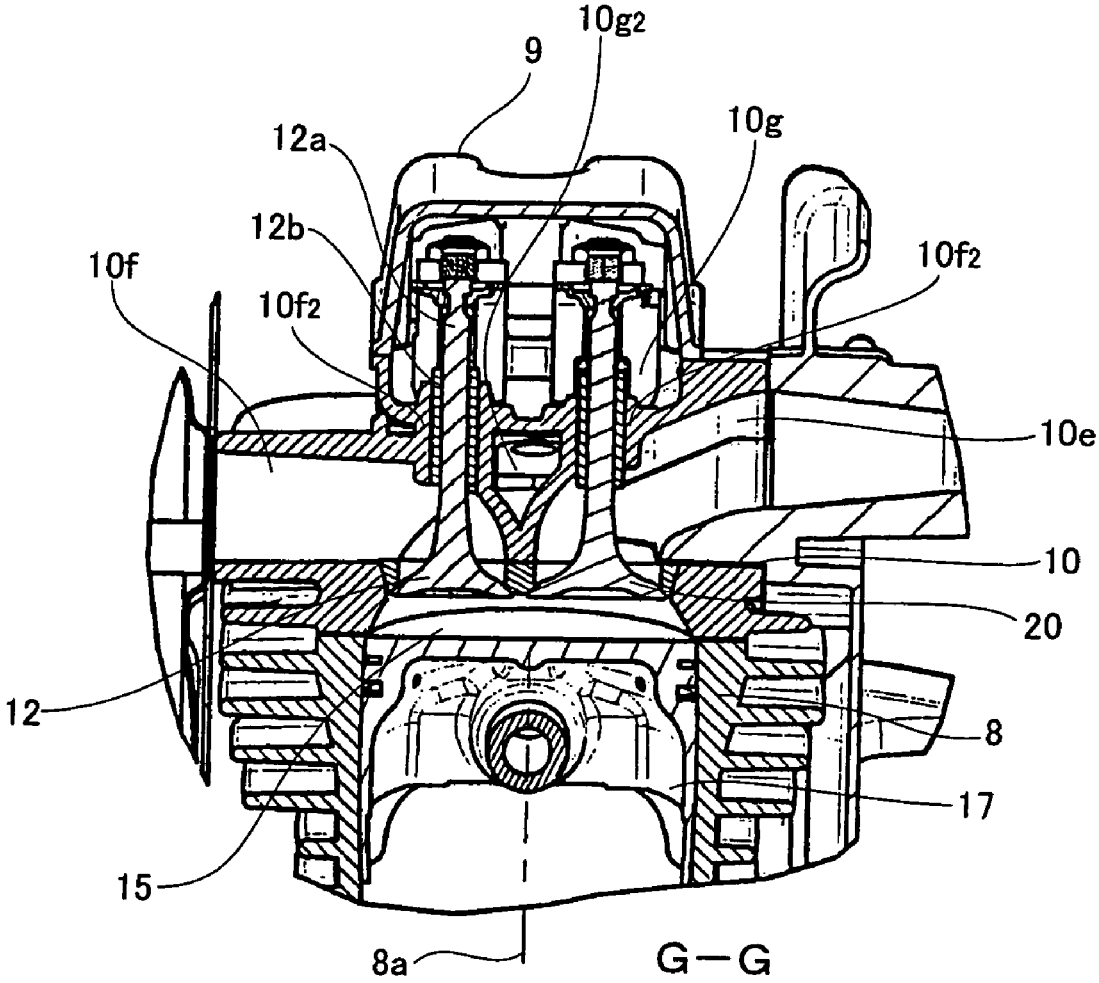
FIG. 6 is a cross-sectional view taken along the line G-G of FIG. 5.

FIG. 5 is a cross sectional view taken along the line A-A of FIG. 4 and illustrates a cross section of the part where the exhaust valve 12 and the push rods 11 are located. FIG. 6 is a cross sectional view taken along the line G-G of FIG. 5 and illustrates a cross section of the part where the intake valve 20 and the exhaust valve 12 are located.

Referring to FIG. 5 and FIG. 6, the cylindrical valve guide 12*b* is retained in the valve guide boss 10*f*2 with which the exhaust port 10*f* and the valve train area 10*g* located opposite each other to the valve guide boss 10*f*2 respectively are integrally formed. The exhaust valve 12 that is supported, in its slidable valve stem 12*a*, by the valve guide 12*b* is opened and closed being driven by the push rod 11 as the crankshaft 5 rotates. Reference numeral 17 in FIG. 5 and FIG. 6 denotes the piston which reciprocates up and down inside the cylinder 8.

The engine drive system is lubricated by known techniques such as the one disclosed in Japanese Unexamined Patent Application Publication No. Hei 10-288019: Oil is fed from an oil tank (not shown) into the crankcase 4 using the change in the crankcase internal pressure, where the oil is nebulized and fed to the push rod guide 10*g*3 to lubricate the intake valve 20, exhaust valve 12 and others in the valve train area 10*g*, after which it is returned to the oil tank. The oil is thus circulated to ensure smooth movement among working parts.

In this embodiment, the bottom 10*g*1 of the valve train area 10*g* is inclined downwards from the upwind side where the ignition plug 14 is located to the downwind side. At the downwind side of the valve train area 10*g* is integrally formed a push rod guide 10*g*3 having bores for accommodating the push rods 11 and extending downward. With this configuration, the lubricating oil which has condensed inside the valve train area 10*g* flows down along the bottom 10*g*1 of the valve train area 10*g* and collects in the push rod guide 10*g*3, and an excess of lubricating oil is prevented from remaining inside the valve train area 10*g*. Although not shown, the valve train area 10*g* includes a breather system so as to return the blow-by gas to the intake system. If a surplus of oil remains in the valve train area 10*g*, the oil is discharged to the outside, and such wasteful consumption may lead to lubrication deficiency of the engine drive system. With the configuration of this embodiment, unnecessary oil consumption is prevented.

Further, with the bottom 10*g*1 of the outer circumference of the valve train area 10*g* forming part of the structure which introduces cooling air into the opening 10*g*2, the cooling effect for the valve train area 10*g* and its vicinity is further enhanced. Since the exhaust valve 12 and its surroundings which tend to be hot are efficiently cooled as mentioned above, troubles such as loosening of the valve guide boss 10*f*2 and the valve guide 12*b* due to high temperature or malfunction of the sliding valve stem 12*a* caused by deformation of the valve guide 12*b* are prevented.

Furthermore, as shown in FIG. 3, the vertical fins 10*d*2 and 10*d*3 are jointed to the valve guide bosses 10*f*2 at locations away from the centers of a pair of valve guide bosses 10*f*2 and at the outer ends of the valve guide bosses 10*f*2 in a direction orthogonal to the crankshaft 5. Therefore, heat conducted from the combustion chamber 15 to the vertical fins 10*d*2 and 10*d*3 hardly reaches the center section of the valve guide bosses 10*f*2, and thus above-mentioned troubles due to the valve guide bosses 10*f*2 with high temperature are prevented.

The combustion chamber 15 of this embodiment is wedge-shaped for achieving high output. Such shape can be formed ideally by the design which has a separate cylinder 8 and cylinder head 10. The ignition plug 14 being located on the deeper side of the combustion chamber 15 further increases the compression ratio and contributes to formation of an ideal combustion chamber shape which results in higher engine output.

Figure 1:
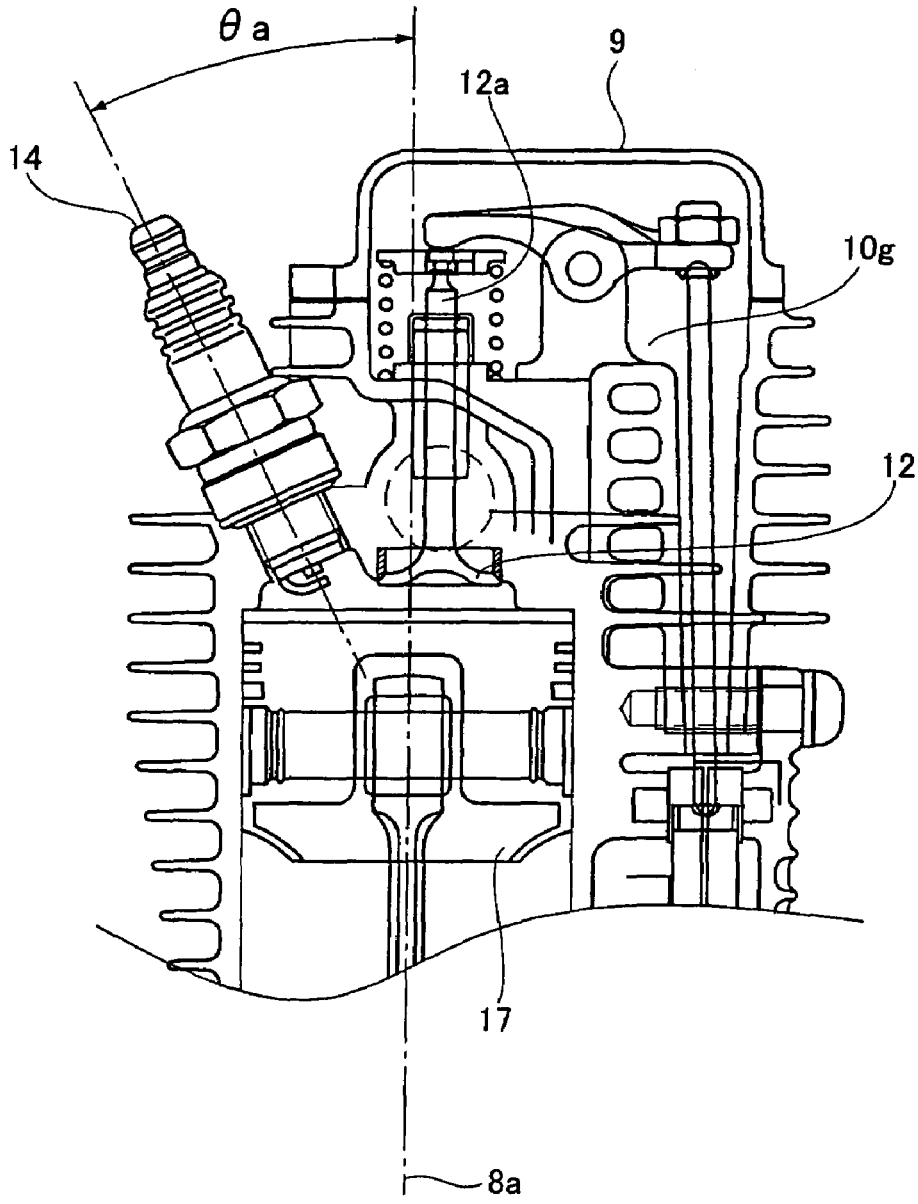
FIG. 1 is a cross-sectional view of a conventional 4-cycle engine equipped on a portable machine.

In this embodiment, as shown in FIG. 5, the ignition plug 14, the intake valve 20 and the exhaust valve 12 are oppositely inclined forming a V-shape from a cross-section view substantially at an equal angle relative to the plane including the centerline 8*a* of the cylinder 8 and being orthogonal to the crankshaft 5. In conventional 4-cycle engines mounted in portable machines, as shown in FIG. 1, the valve stem 12*a* of the exhaust valve 12, and, though not shown in FIG. 1, the intake valve stem, are arranged parallel to the cylinder centerline 8*a* for productivity reasons. The angle θa between the ignition plug 14 and the cylinder centerline 8*a* is large, as the ignition plug 14 is located at the edge of the combustion chamber and largely inclined to one side. Therefore, the ignition plug 14 could not be located on the side of the machine, particularly in the case of a blower or the like, because otherwise impaired maintenance accessibility for plug exchange may occurs. In the 4-cycle engine according to the present embodiment, the ignition plug 14, the intake valve 20, and the exhaust valve 12 are arranged in a well-balanced way relative to the centerline 8*a* of the cylinder 8 as shown in FIG. 5, the inclination angle θb of the ignition plug 14 relative to the center line 8*a* of the cylinder 8 is made small. Accordingly, the ignition plug 14 can be located on the side of the machine (fan 6) without making difficult the maintenance accessibility of the portable machine 1.

In the present embodiment, the valve train area 10*g* is formed in the cylinder head 10 at the downwind side of the cooling air, with the push rod guide 10*g*3 communicating with the valve train area 10*g*, and therefore the valve train components (not shown) is mounted on the crankshaft 5 at the downwind side. This means that the engine can be connected to the machine body including the crankshaft 5 and the fan 6 on the opposite side from the push rod guide 10*g*3, as with this embodiment, with a shorter connection shaft length. A shorter length of connection shaft between the crankshaft 5 and the fan 6 means less shaft wobbling and less vibration of the machine 1. In the case of the back pack blower 1 shown in FIG. 8, in particular, the load on the operator's hip is reduced as the machine 1 can be mounted close to the back pack frame 21, that is, the center of gravity of the machine 1 is closer to the hip of the operator.

The intake port 10*e*, the exhaust port 10*f*, and some of the vertical fins 10*d*1 etc., are located around the bolt head shoulders 10*c* where the joint condition between the cylinder 8 and the cylinder head 10 is ideal. With this configuration, the cylinder head 10 has high rigidity around the bolt head shoulders 10*c*, making it less likely that deformation occurs at the joint interface. That is, the cylinder 8 and the cylinder head 10 of this portable 4-cycle engine 2 have high surface pressure on their joint surfaces 10*b*.

Figure 8:
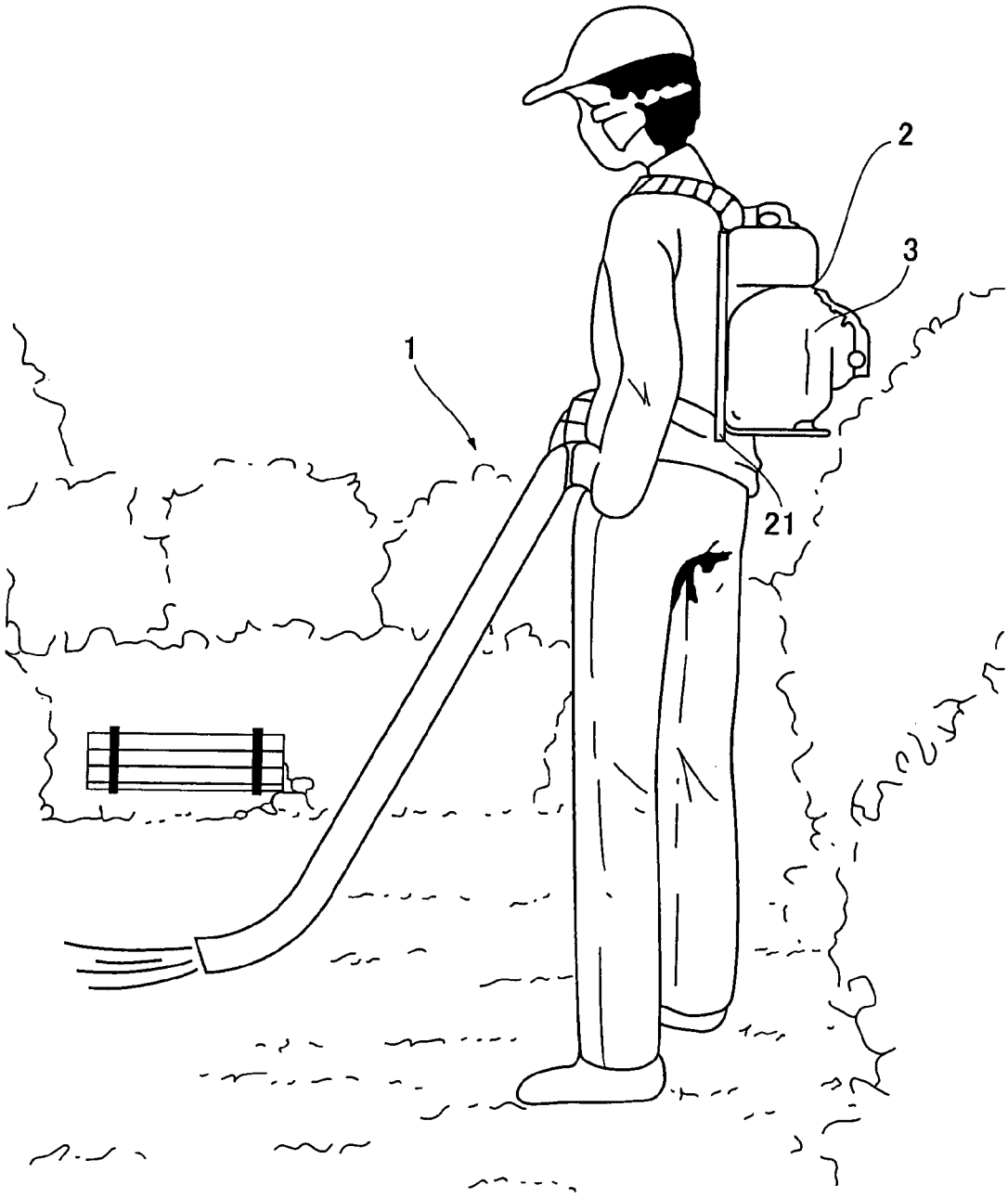
FIG. 8 illustrates one example of use of the portable machine equipped with the 4-cycle engine according to one embodiment of the present invention.
Figure 9:
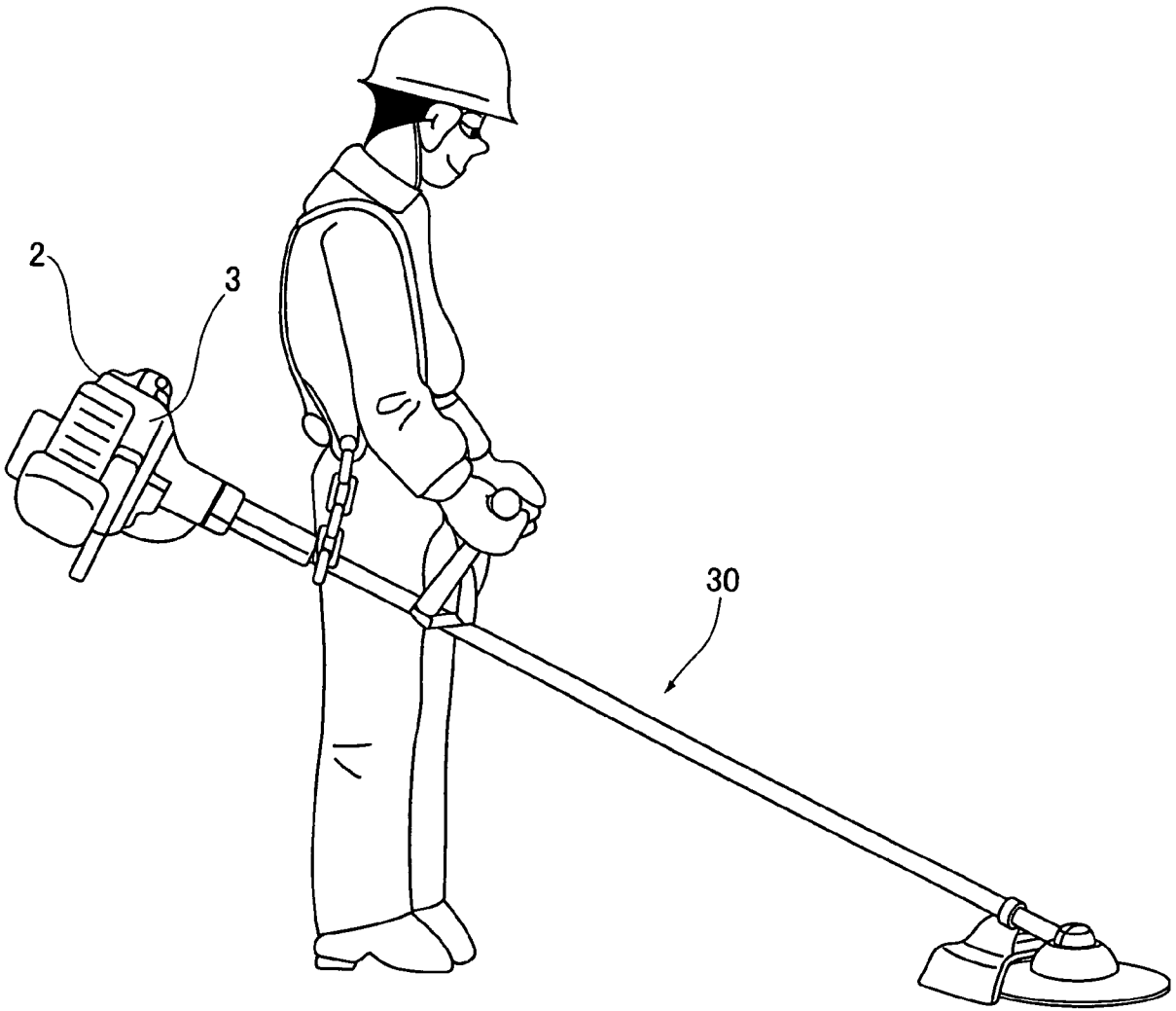
FIG. 9 illustrates another example of use of the portable machine equipped with the 4-cycle engine according to another embodiment of the present invention.

FIG. 8 and FIG. 9 illustrate examples of use of portable machines 1 and 30 equipped with the 4-cycle engine 2 of this invention. FIG. 8 shows a back pack blower 1, and FIG. 9 shows a portable bush cutter 30. As shown in FIG. 8, this embodiment of the portable machine or the back pack blower 1 includes the 4-cycle engine 2 encased in the engine cover 3 mounted on its drive part as the power source. The operator carries the machine output part including the engine 2 attached to the back pack frame 21 on his back to perform cleaning such as clearing away leaves or other debris with the blower.

FIG. 9 shows one example of use of the bush cutter 30, which is another embodiment of the portable machine of the invention. The 4-cycle engine 2 encased in the engine cover 3 is mounted on the drive part of the bush cutter 30 as the power source. The operator carries the bush cutter 30 hung on a belt or the like attached to the cutter to perform various duties such as cutting off weeds or mowing lawn.

As such machines 1 and 30 are carried by the operator during operation, the power source engine 2 is desired to be small, light, and powerful. The portable 4-cycle engine of the present invention is capable of high power output and has excellent maintenance accessibility, as described above, without increasing the size or weight as compared to the conventional engines. Also, the portable machine equipped with this engine as the power source is small, light, and powerful, and has good operation efficiency and maintenance accessibility.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A portable 4-cycle engine allowing cooling air to flow in a direction of a crankshaft, comprising:

a cylinder;

a cylinder head disposed on said cylinder, and including a combustion chamber at a side of said cylinder;

an intake port and an exhaust port, said intake port and said exhaust port being oppositely formed with each other in said cylinder head in a direction orthogonal to said crankshaft;

a cooling fan for introducing the cooling air to said cylinder head, said cooling fan being connected to an end of the crankshaft;

a valve train area formed above said intake port and said exhaust port, said valve train area being connected to said intake port and said exhaust port with a pair of valve guide bosses; and a plurality of vertical fins protruding upwardly from said cylinder head and extending in the direction of said crankshaft, wherein:

said valve train area and said plurality of vertical fins are integrally formed with said cylinder head;

said cylinder head, said intake port, said exhaust port, said valve guide bosses and a bottom of said valve train area together form an opening, through which the cooling air flows; and said opening is formed to have a decreasing cross-sectional area from an upwind side toward a downwind side of said cooling air.

2. The portable 4-cycle engine according to claim 1, wherein said vertical fins are located at positions a predetermined distance away from respective centers of said valve guide bosses.

3. The portable 4-cycle engine according to claim 1, wherein at least one of said vertical fins is connected to said valve train area at one end of a direction orthogonal to said crankshaft.

4. A portable machine, comprising:

the 4-cycle engine according to claim 1 as a power source for the portable machine.

5. A portable 4-cycle engine allowing cooling air to flow in a direction of a crankshaft, comprising:

a cylinder;

a cylinder head disposed on said cylinder, and including a combustion chamber at a side of said cylinder;

an intake port and an exhaust port, said intake port and said exhaust port being oppositely formed with each other in said cylinder head in a direction orthogonal to said crankshaft;

a cooling fan for introducing the cooling air to said cylinder head, said cooling fan being connected to an end of the crankshaft;

a valve train area formed above said intake port and said exhaust port, said valve train area being connected to said intake port and said exhaust port with a pair of valve guide bosses; and a plurality of vertical fins protruding upwardly from said cylinder head and extending in the direction of said crankshaft, wherein:

said valve train area and said plurality of vertical fins are integrally formed with said cylinder head;

said cylinder head, said intake port, said exhaust port, said valve guide bosses and a bottom of said valve train area together form an opening, through which the cooling air flows;

a push rod guide having bores for accommodating a pair of push rods is formed in said valve train area at the downwind side of said cooling air;

said bottom of said valve train area inclines downwardly from the upwind side of said cooling air toward the side of said push rod guide; and the upwind side of said valve train area is connected to said intake port and said exhaust port with said vertical fins.

6. The portable 4-cycle engine according to claim 5, wherein said vertical fins are located at positions a predetermined distance away from respective centers of said valve guide bosses.

7. The portable 4-cycle engine according to claim 5, wherein at least one of said vertical fins is connected to said valve train area at one end of a direction orthogonal to said crankshaft.

8. A portable machine, comprising:

the 4-cycle engine according to claim 5 as a power source for the portable machine.

9. A portable 4-cycle engine allowing cooling air to flow in a direction of a crankshaft, comprising:

a cylinder;

a cylinder head disposed on said cylinder, and including a combustion chamber at a side of said cylinder;

an intake port and an exhaust port, said intake port and said exhaust port being oppositely formed with each other in said cylinder head in a direction orthogonal to said crankshaft;

a cooling fan for introducing the cooling air to said cylinder head, said cooling fan being connected to an end of the crankshaft;

a valve train area formed above said intake port and said exhaust port, said valve train area being connected to said intake port and said exhaust port with a pair of valve guide bosses; and a plurality of vertical fins protruding upwardly from said cylinder head and extending in the direction of said crankshaft, wherein:

said cylinder head, said intake port, said exhaust port, said valve guide bosses and a bottom of said valve train area together form an opening, through which the cooling air flows;

said valve train area and said plurality of vertical fins are integrally formed with each other and are also integrally formed with said cylinder head;

said vertical fins are located at positions a predetermined distance away from respective centers of said valve guide bosses; and one of said vertical fins connected with an outer periphery of said exhaust port extends from said opening to said cooling fan side, and an ignition plug is located near the vertical fin and said opening so as to effectively introduce the cooling air to the outer periphery of said exhaust port.

10. The portable 4-cycle engine according to claim 9, wherein:

at least one of said vertical fins is connected to said valve train area at one end of a direction orthogonal to said crankshaft;

said cylinder head is separably disposed on said cylinder;

said cylinder head includes a plurality of bolt head shoulders having insertion holes for bolts to tighten said cylinder head with said cylinder;

said intake port and said exhaust port have centerlines located at the downwind side relative to the centerline of said cylinder; and said intake port, said exhaust port and said vertical fins are located in the vicinity of said plurality of bolt head shoulders.

11. The portable 4-cycle engine according to claim 9, wherein said combustion chamber is formed in a wedge shape.

12. A portable machine, comprising:

the 4-cycle engine according to claim 9 as a power source for the portable machine.

13. The portable machine according to claim 12, wherein:

said portable machine comprises a blower;

said engine further comprises an intake valve and an exhaust valve provided in said cylinder head; and said ignition plug is oppositely inclined to said intake valve and said exhaust valve substantially at an equal angle relative to a plane including a centerline of said cylinder and being orthogonal to said crankshaft, and said engine and a machine body are connected at the opposite side of said intake and exhaust valves in order to allow a shorter distance between the machine body and the engine and easy maintenance of said plug.

* * * * *